US006843592B2

(12) United States Patent
Taylor et al.

(10) Patent No.: US 6,843,592 B2
(45) Date of Patent: Jan. 18, 2005

(54) ASPHALT ADDITIVE MIXING APPARATUS

(76) Inventors: Kevin Taylor, Broadway House, 21 Broadway, Maidenhead, Berkshire SL6 INJ (GB); Franz Smet, Broadway House, 21 Broadway, Maidenhead, Berkshire SL6 INJ (GB)

( * ) Notice: Subject to any disclaimer, the term of this patent is extended or adjusted under 35 U.S.C. 154(b) by 77 days.

(21) Appl. No.: 09/898,900

(22) Filed: Jul. 3, 2001

(65) Prior Publication Data

US 2002/0075753 A1 Jun. 20, 2002

(30) Foreign Application Priority Data

Jul. 4, 2000 (GB) ..... 0016442

(51) Int. Cl.[7] ..... B01F 7/24; B01F 15/02; B28C 5/16

(52) U.S. Cl. ..... 366/18; 366/20; 366/65; 366/141; 366/191

(58) Field of Search ..... 366/8, 16, 18, 366/20, 64, 65, 141, 191

(56) References Cited

U.S. PATENT DOCUMENTS

| | | | | |
|---|---|---|---|---|
| 388,724 A | * | 8/1888 | Schumm | |
| 1,933,543 A | * | 11/1933 | Anderson | 366/10 |
| 3,237,865 A | * | 3/1966 | Kovach | 239/142 |
| 3,574,411 A | * | 4/1971 | Miller | 406/65 |
| 3,719,214 A | * | 3/1973 | Erndt | 141/51 |
| 3,741,532 A | | 6/1973 | Farnham et al. | |
| 3,809,436 A | * | 5/1974 | Ciaffone | |
| 3,881,702 A | * | 5/1975 | McIver | 366/107 |
| 3,951,462 A | * | 4/1976 | De Francisci | |
| 4,025,057 A | | 5/1977 | Shearer | |
| 4,060,223 A | | 11/1977 | Bongartz et al. | |
| 4,222,498 A | | 9/1980 | Brock | |
| 4,339,202 A | | 7/1982 | Hart et al. | |
| 4,339,277 A | | 7/1982 | Schult | |
| 4,498,783 A | * | 2/1985 | Rudolp | |
| 5,423,606 A | * | 6/1995 | Milstead | |
| 5,529,247 A | | 6/1996 | Mieczewski | |
| 5,634,716 A | * | 6/1997 | Westall et al. | |
| 5,667,298 A | * | 9/1997 | Musil et al. | |
| 5,730,523 A | * | 3/1998 | Flood | |
| 5,908,240 A | * | 6/1999 | Hood | |
| 6,007,236 A | * | 12/1999 | Maguire | |
| 6,186,654 B1 | * | 2/2001 | Gunteret, Jr. et al. | |

FOREIGN PATENT DOCUMENTS

| | | | |
|---|---|---|---|
| CH | 649 943 A5 | * | 6/1985 |
| DE | 2919444 A1 | | 11/1980 |
| DE | 3834191 A1 | | 12/1990 |
| GB | 2 095 569 A | | 10/1982 |
| GB | 2291600 A | | 1/1996 |
| GB | 2 291 600 A | | 1/1996 |

OTHER PUBLICATIONS

European Search Report, Publication No. EP 1 170 421 A3, Application No. EP 01 11 4806, Date of Search Jul. 8, 2003.

* cited by examiner

*Primary Examiner*—David Sorkin

(57) ABSTRACT

An apparatus and methods for blending and for delivering additives, for example, in pelletised form, to form thin surface dressings for the pavement construction industry. One or more additives may be weighed, blended and transferred for combination of the blended pelletised additives into an aggregate and bitumen mix.

19 Claims, 5 Drawing Sheets

FIG. 2
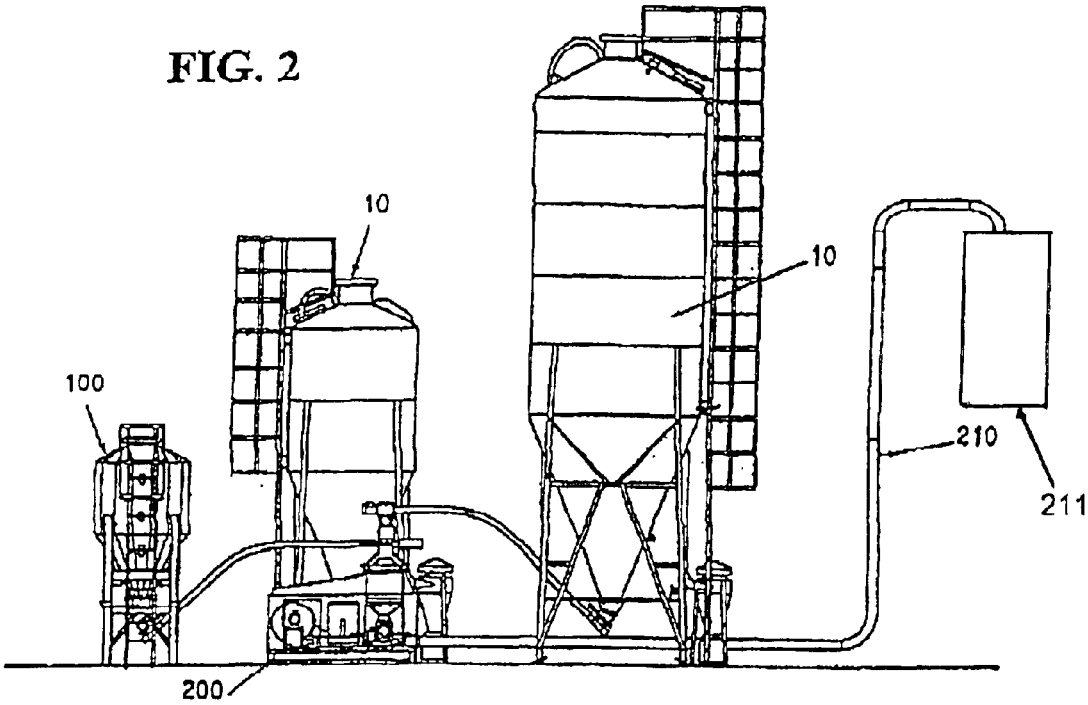
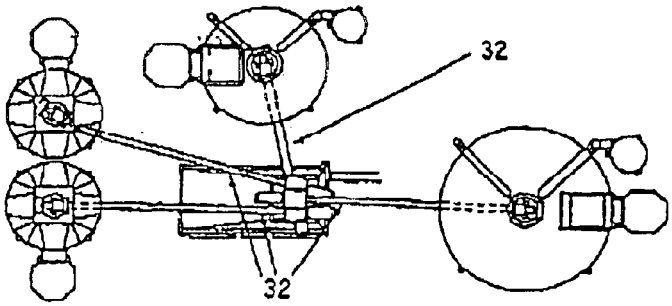
FIG. 3

FIG. 7A
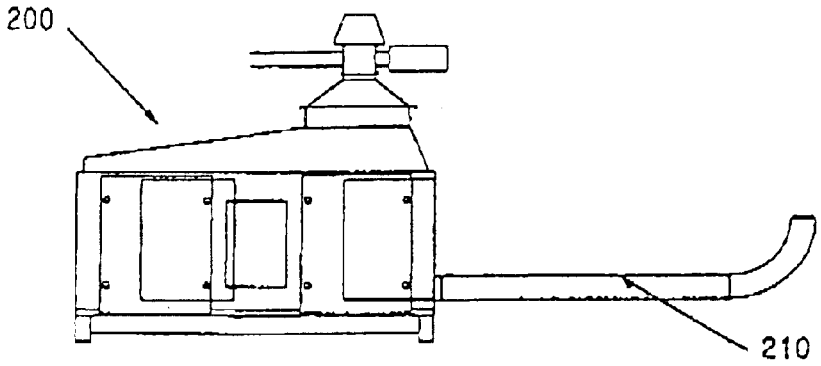
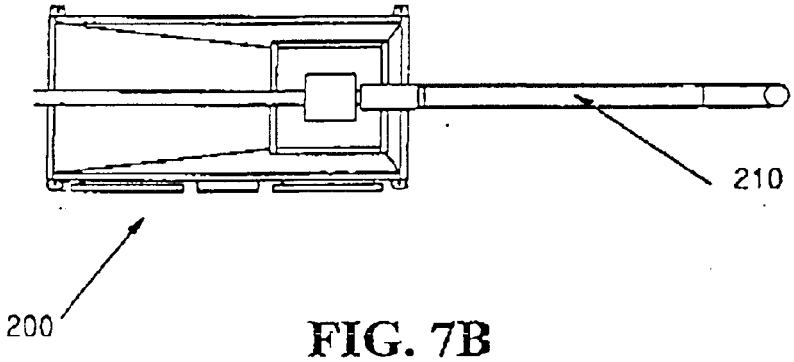
FIG. 7B
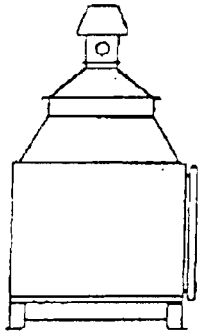
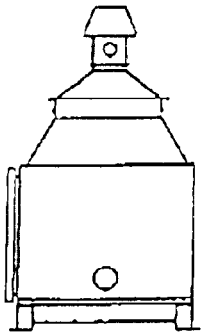
FIG. 7C
FIG. 7D

ASPHALT ADDITIVE MIXING APPARATUS

RELATED APPLICATIONS

This application claims the benefit of the filing date under 35 U.S.C. §119 of Great Britain Application No. 0016442.6, filed Jul. 4, 2000, which is hereby incorporated by reference in its entirety.

FIELD OF THE INVENTION

The present invention relates to the production of high quality pavement. In particular, the present invention relates to an apparatus and methods suitable for incorporating pelletised additives into thin surface dressings.

BACKGROUND OF THE INVENTION

Stone Mastic Asphalt (SMA), an example of a thin surface dressing, was developed in the early 1970s in Germany (originally to resist the wear of studded tyres) where to date, over 250 million square meters of highway have been paved with this product. The successful production of SMA is typically made possible with the use of stabilising additives in the form of highly specialised cellulose fibres. These prevent excessive drainage of the asphalt binding agent (bitumen).

The advantages of thin surface dressings over conventional road surface applications are now well recognised and its use is increasing at a steady pace. For example, due to its excellent characteristics and performance, SMA has been adopted in many countries, including the Netherlands, France, Switzerland, UK, Norway, Finland, Sweden, Denmark, Turkey, Greece, Poland, Japan, Israel and the USA.

Asphalt production plants which manufacture blends of aggregate and bitumen for use in the production of thin surface dressings, were not designed with these new products in mind. Such plants consist of large storage vessels holding bulk raw materials, such as aggregate and bitumen, which are then conveyed to a central elevated mixing box for blending. The asphalt mixing box typically has a height similar to that of a three or four story building. The raw materials are typically mixed in a ratio of 1 tonne of aggregate to 200 kg of fillers and binders, the latter typically comprising 70–100 kg of bitumen. Blending takes place at an elevated temperature of typically 170° C. However, the industry is moving towards production of technically more sophisticated thin surface dressings that require the incorporation of multiple additives. In contrast to the relatively large proportion of bitumen in a finished asphalt product, these further additives are incorporated in relatively small amounts, such as 3 kg of fibre, 10 kg of pigment and 5 kg of a polymer modifier per tonne of aggregate.

Accordingly, these new products are manufactured today either by manual addition of the multiple additives into the asphalt mixing box or by means of a supply system as shown in FIG. 1.

The additive supply system shown in FIG. 1 comprises components and operates as follows. A bulk silo 10 for storing an additive in pelletised form is filled by means of a filler pipe 12. Additive can be added to the bulk silo 10 by being blown up filler pipe 12. A safety ladder 14 enclosed by safety rails 16 provides access to a hinged roof hatch 18 at the top of bulk silo 10. A high level probe 20 located at the top of bulk silo 10 indicates when the silo is full. Gas is exhausted down exhaust pipe 22, to which a cyclone dust collector 24 is fitted. The bulk silo 10 is emptied by agitation of its contents at low level using rotary electric vibrators 26. A level probe 28 and an emergency low level probe 30 respectively indicate when the bulk silo 10 is nearly or completely empty. Additive leaving the silo is conveyed by a supply auger 32 to the asphalt mixing box. The supply auger may be provided with a calibration or sampling point 34 and an acoustic flow detection sensor 36. The auger 32 is driven by a drive unit 38 which draws additive to outlet 40 and into the asphalt mixing box. The elevated asphalt mixing box is accordingly fed with additive from the bulk silo 10 from above. The quantity of additive added to each batch of asphalt is controlled simply by the run duration time of drive unit 38.

SUMMARY OF THE INVENTION

The inventors have appreciated that both the manual addition of additives and the FIG. 1 supply system may have disadvantages as follows.

Manual addition of additives into the mixing box creates health and safety hazards for operators, as the additives can be dusty and of a dangerous nature. Manual addition also has a tendency to result in inconsistency in the blending process, accidental losses and inconsistent end products.

On the other hand, the additive supply system shown in FIG. 1, which reduces these hazards, is only designed to incorporate a single additive volumetrically into the asphalt mixing box.

In addition, asphalt production plants are often sited in restricted areas where storage space is limited. The current design of these plants requires that storage vessels for additives, such as that shown in FIG. 1, are located significant distances from the asphalt mixing box. This is because supply auger 32 shown in FIG. 1 cannot be oriented at an angle greater than about 45° to the horizontal, otherwise additive pellets drop back down the auger under gravity and the flow of additive from silo 10 to the asphalt mixing box is impeded. Accordingly, storage facilities for each new additive required would similarly need to be sited at an appreciable distance from the asphalt mixing box and augered in. If the asphalt product in question requires a number of additives, storage systems as shown in FIG. 1 would need to be replicated several times over, causing potential problems siting the additive supply units around the asphalt mixing box due to lack of space. With such a plurality of additive supply systems, it also remains difficult to achieve a good blend of additives, giving a similar disadvantage to the manual addition of such additives.

Furthermore, the industry is also looking to create new asphalt products with a wide range of colours in response to the drive towards improved road safety and to aesthetic considerations in speciality applications, such as driveways or parking zones where standard black asphalt is less preferred. Currently these needs are not being met, with only a narrow range of colours being available. Existing asphalt manufacturing plants have in general little flexibility for rapid changes in the additive formulations used without significant loss of out-of-specification end products.

An object of certain aspects of the present invention, therefore, is to overcome the disadvantages exhibited by these conventional techniques and to permit the manufacture of thin surface dressings incorporating one or more pre-blended additives in a precise, reproducible manner.

Accordingly, in a first aspect, the present invention provides an apparatus for providing at least one additive for incorporation in an asphalt, said apparatus comprising: a receptacle constructed and arranged to receive one or more of said additives; a scale adapted to measure respective gravimetric amounts of said one or more additives that are received by the receptacle; a mixer adapted to mix said one or more additives in said receptacle into a blend; and a transport system that delivers said blend from said receptacle for delivery to an asphalt mixing box.

In a second aspect, the present invention also provides a method of blending additives for incorporation in an asphalt, said method comprising: feeding one or more of said additives into a receptacle; weighing each additive to achieve a desired proportion thereof in a desired total amount of said additives; mixing said additives in said receptacle into a blend; and transferring said blend from said receptacle for delivery to an asphalt mixing box.

In a third aspect, the present invention further provides an apparatus for delivering additives for incorporation in an asphalt to an asphalt mixing box, said apparatus comprising: a receptacle constructed and arranged to receive said additives, said receptacle having an input for said additives locatable at a level substantially lower than an input for said additives to said asphalt mixing box; a mixer adapted to mix said additives and prepare a blend; a transfer pipe connected between an output of said receptacle to the input of said asphalt mixing box; and a pneumatic pressure source connected to said transfer pipe that conveys said blend along said transfer pipe from near the output of said receptacle to the input of said asphalt mixing box.

In a fourth aspect, the present invention further provides a method of delivering additives for incorporation in an asphalt to an asphalt mixing box, said method comprising: supplying said additives to a receptacle for preparing a blend of said additives at a level substantially lower than an input for said additives to said asphalt mixing box; and pneumatically conveying a blend of additives output of said receptacle to the input of said asphalt mixing box.

In one illustrative embodiment, an apparatus according to the third aspect of the invention uses an apparatus according to the first aspect of the invention as means for preparing a blend of said additives. In other words, an apparatus according to the first aspect of the invention preferably uses an apparatus according to the third aspect of the invention as means for delivering said blend to an asphalt mixing box. Likewise, a method according to the fourth aspect of the invention further comprises, after said supplying step and before said conveying step, blending said additives by a method according to the second aspect of the invention. In other words, a method according to the second aspect of the invention preferably further comprises a method of delivering said additives to an asphalt mixing box according to the fourth aspect of the invention.

In another illustrative embodiment, the apparatus according to the first aspect of the invention further comprises a control system having an input from a weighing means, such as the scale, and control outputs to an inlet of said receptacle and to said mixer and said transport system, said control system being programmable to regulate receipt of said additives through said receptacle inlet based on gravimetric amounts of additives measured by said weighing means until a desired total amount of said additives in desired proportions thereof is achieved, and to operate said mixer and said transport system sequentially thereafter.

The features of an apparatus according to the first aspect of the invention and of a method according to the second aspect of the invention may give improved performance, consistency and range of end products after incorporation of the additives into an asphalt. Accordingly, these aspects of the invention provide an effective manner of creating a wide palette of easily reproducible coloured thin surface dressings, such as those required for speciality applications, by blending pelletised colour pigments to create a consistent range of graded colours. The improved accuracy of desired proportions of additives and thorough pre-blending that may be achieved by these aspects of the invention prior to their incorporation into an asphalt give improved performance characteristics due to the improved uniformity of dispersion of the additives in question through the asphalt when laid as a pavement.

The third and fourth aspects of the invention may provide advantages in the siting and distribution of additive storage vessels around an asphalt mixing box. Since the means for preparing a blend of said additives has an input for said additives locatable at a level substantially lower than an input for said additives to said asphalt mixing box, additive storage vessels may be located very close to said blending means. This is because augers delivering additives from said additive storage vessels need only cover a small horizontal distance in order to lift additives from the respective storage vessels to a height sufficient to be input to the blending means in comparison to the much larger horizontal distance that would otherwise be required to lift additives from the respective storage vessels to the top of an asphalt mixing box. On the other hand, since a pneumatic pressure source is used to convey a blend of additives from an output of said blending means to an input of said asphalt mixing box, the transfer pipe connecting the output of the blending means to the input of the asphalt mixing box may include a vertical portion, which would not be achievable with an auger. For this reason, the blending means may be located very close to the asphalt mixing box. A large number of additive storage vessels may therefore by sited in close proximity to an asphalt mixing box, which has previously been impossible. The pneumatic pressure source may either be a blower or a vacuum pump.

Preferably, although not necessarily, the additives are blended and delivered to the asphalt mixing box in pelletised form. This may aid both the blending and the delivery procedures.

BRIEF DESCRIPTION OF THE DRAWINGS

Further features and advantages of the present invention will be better understood by reference to the following detailed description giving in association with the accompanying drawings, in which:

FIG. 2 is a side elevational view of an additive mixing apparatus according to an embodiment of the invention, shown in situ with a plurality of additive storage vessels;

FIG. 3 is a plan view of the arrangement shown in FIG. 2;

FIG. 7A is a side elevational view of the exterior of the additive mixing apparatus;

FIG. 7B is a plan view of the exterior of the additive mixing apparatus shown in FIG. 7A;

FIG. 7C is a front elevational view of the exterior of the additive mixing apparatus shown in FIG. 7A; and FIG. 7D is a rear elevational view of the exterior of the additive mixing apparatus shown in FIG. 7A.

DETAILED DESCRIPTION

Figure 1:
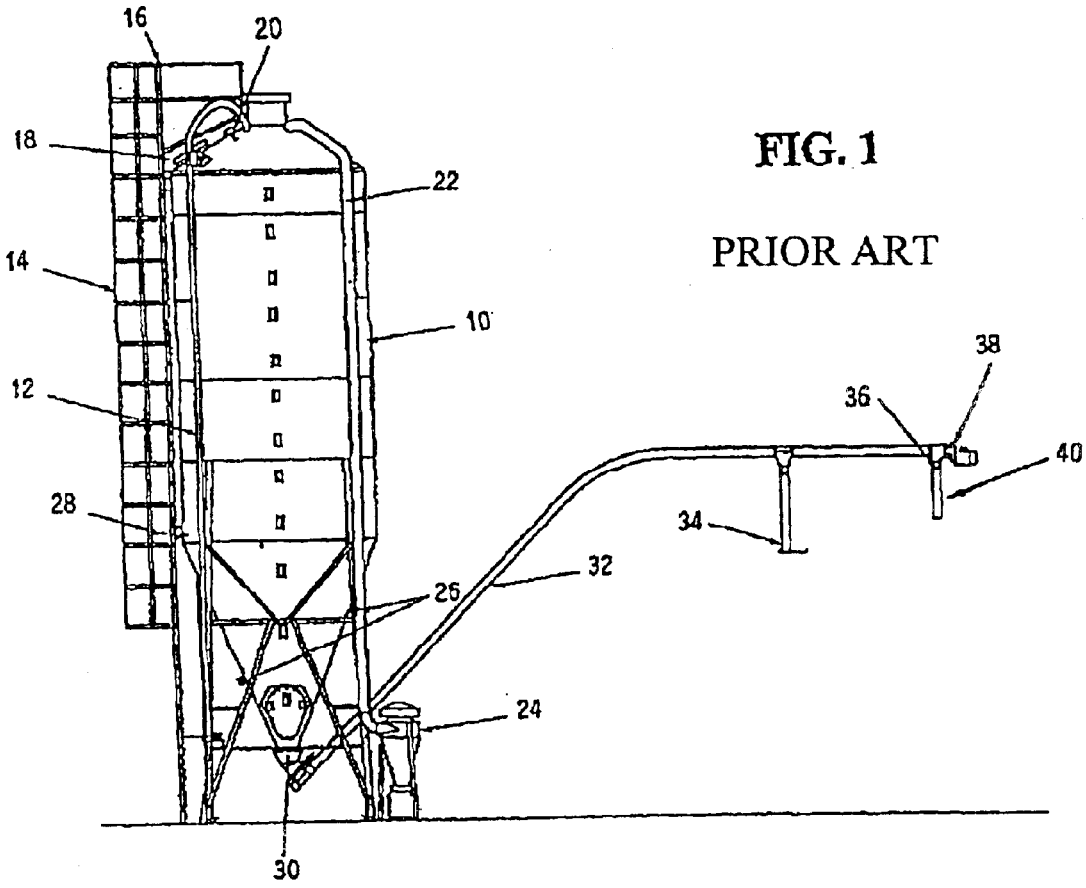
FIG. 1 PRIOR ART
FIG. 1 is a side elevational view of a conventional supply system for providing an additive to an asphalt mixing box.

Referring firstly to FIG. 2, an embodiment of an additive mixing apparatus according to the invention, represented generally by reference numeral 200, is shown in association with a plurality of additive storage vessels. The additive storage vessels may comprise one or more bulk silos 10 of the type also shown in FIG. 1 and/or one or more cari silos 100. Whereas bulk silos 10 are permanently sited, a cari silo may be removed and replaced using a fork-lift truck. Apparatus 200 is connected to each of the additive storage vessels associated therewith by an independent centreless auger for each respective storage vessel as indicated by reference numerals 32 in FIG. 3. Each additive may be stored in pelletised form in a respective silo of appropriate size defined by the expected addition rate of the additive in question to the thin surface dressings to be prepared. As shown in FIG. 2, apparatus 200 is provided with a transfer pipe 210, by means of which blended pelletised additives are transferred by a positive pressure pneumatic conveying system to an elevated asphalt mixing box (shown schematically at reference 211), where they are combined with the bulk components such as aggregate and bitumen.

Figure 4:
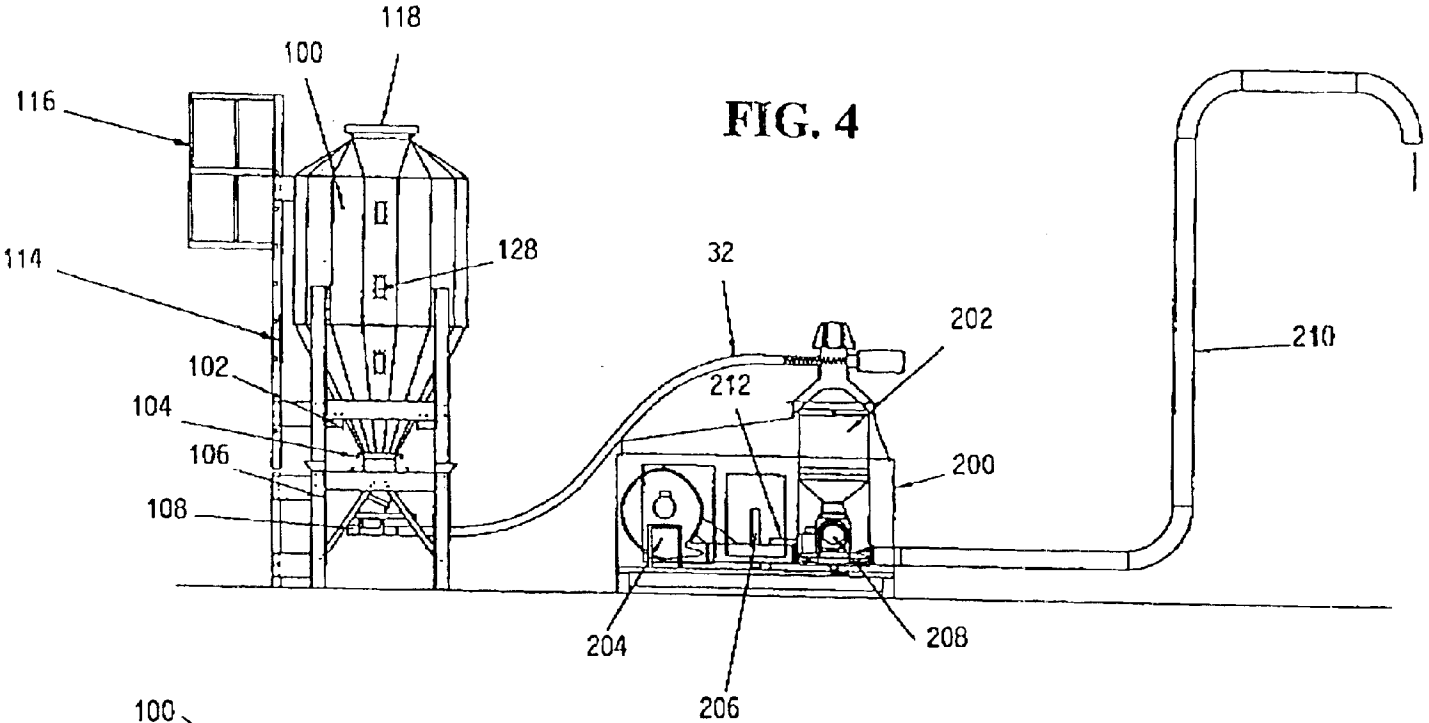
FIG. 4 is a side elevational view of an embodiment of an additive mixing apparatus shown in situ with a single additive storage vessel.

FIG. 4 shows apparatus 200 in association with a single cari silo 100. Apparatus 200 comprises a material reception hopper 202 which enables precise, reproducible batch quantities of pelletised additives to be weighed in controlled conditions using a scale, which may include one or more high-accuracy load cells 214 (shown later in FIG. 6), other force or pressure transducers, a balance-type mechanism, a spring or other member whose deformation is indicative of the weight of the additives, or any other suitable weighing apparatus or weighing means. Apparatus 200 further comprises a transport system that transports the additives from the hopper 202 for delivery to an asphalt mixing box and may include one or more of a blower 204, a pneumatic slide valve 206, a rotary valve 208, and a silencer 212, all of which are described in greater detail below in association with FIG. 6. That is, the transport system may include only the rotary valve 208 or other similar apparatus that delivers material from the hopper 202, or may include the rotary valve 208, the slide valve 206, and the silencer 212. Of course, in some embodiments, the transport system may be arranged to include or operate in cooperation with other elements than those shown in FIG. 6, such as auger-type transport systems, conveyors, etc.

Cari silo 100 is provided with a hinged top hatch 118 and visual level indicators 128, and is mounted on the weatherproof slide 104 of a base unit 106. Base unit 106 further comprises a fixed ladder 114 with safety rails 116, fork lift channels 102 to permit removal of cari silo 100 from base unit 106, and an auger pick-up unit 108 for connection of cari silo 100 to supply auger 32. Auger pick-up unit 108 is designed to minimise losses of additive by use of a valve at the base of the cari silo, which seals the silo when disconnected from auger 32.

Figure 5:
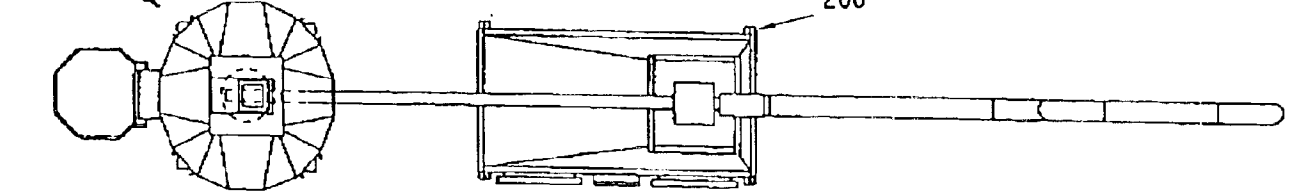
FIG. 5 is a plan view of the arrangement shown in FIG. 4.

FIG. 5 shows the same arrangement as above, in which the cari silo and apparatus according to this embodiment are again represented by reference numerals 100 and 200, respectively.

Figure 6:
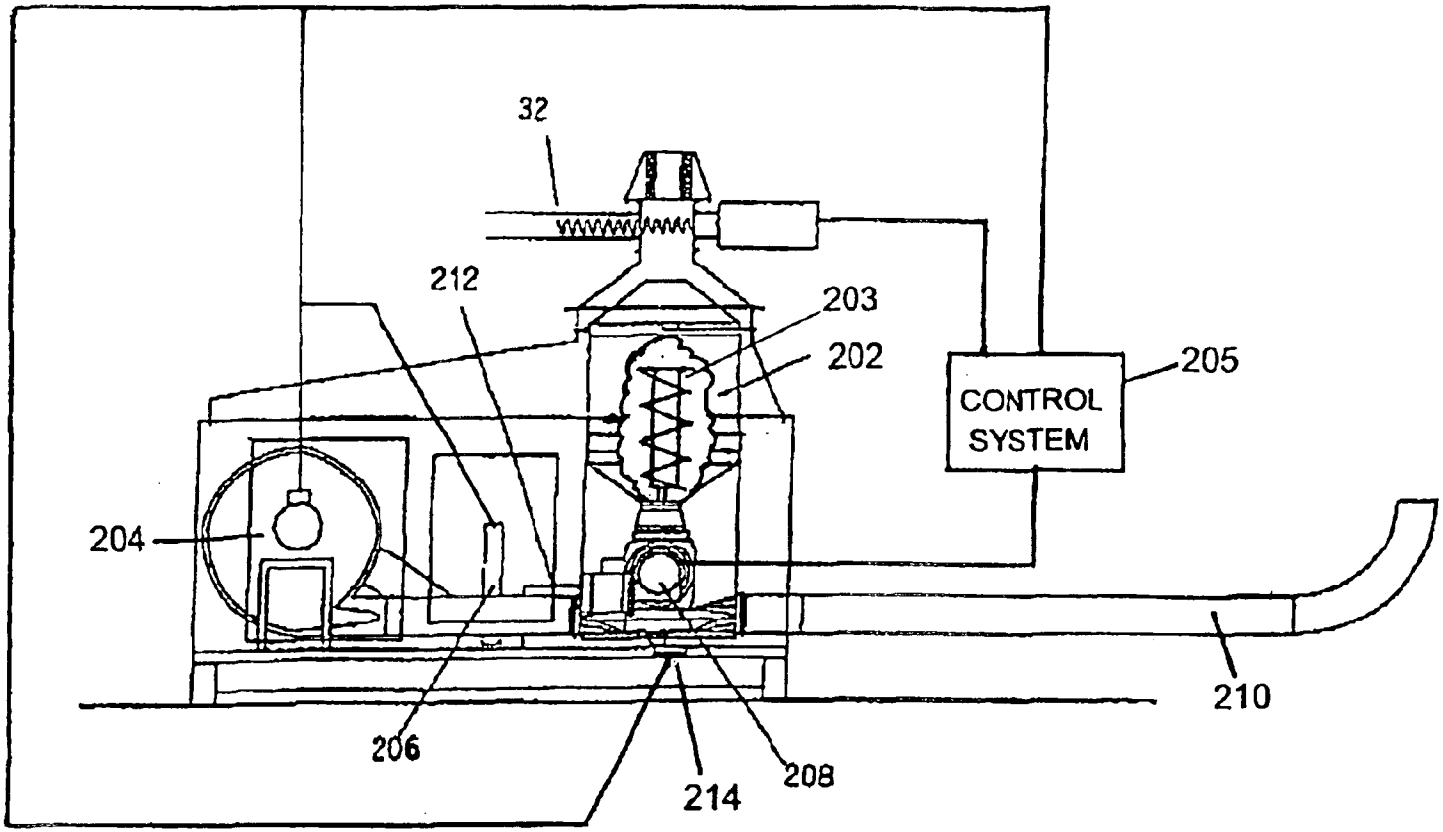
FIG. 6 is a close-up side elevational view of the FIG. 4 additive mixing apparatus, showing the internal components thereof.

A close-up side elevational view of the apparatus 200 is shown in FIG. 6, which reveals the internal components of apparatus 200. In this embodiment, apparatus 200 comprises components and operates as follows. Material reception hopper 202, which may have a capacity of 200 liters, receives pelletised additives from one or more supply augers 32. A scale, in this embodiment one or more load cells 214 which are tared to account for the weight of material reception hopper 202 when empty, permit gravimetric addition of pelletised additives to hopper 202 in desired proportions. In the present embodiment, load cell 214 has a capacity of 250 kg and is provided with optional anti-vibration, anti-shock loading mounting pads. In an alternative embodiment not shown in FIG. 6, material reception hopper 202 may instead be suspended from three load cells each having a capacity of 100 kg, which themselves are suspended from the main body of apparatus 200. Other scale arrangements will occur to those of skill in the art, such as arrangements in which additives are weighed before being deposited in the hopper 202. Sequential addition of additives of known weight from their respective storage vessels gives an extremely flexible system. With these embodiments, a weighing accuracy of +/−0.5% can be achieved. This control eliminates problems with over-dosage and accidental spillage of the pelletised additives, which are expensive. Following addition of pelletised additives in desired proportions to the hopper 202 as determined by means of load cell 214, the contents of hopper 202 are mixed by a mixer, which in this embodiment includes a vertical auger 203 centrally located in the hopper 202, although the mixer may include other elements such as paddles, a vibratory mixing arrangement, or other mixing means to mix the additives into a blend (not shown in FIG. 6). The blend of additives created need not be a perfect mixture, instead any suitable mixing of the additives, whether in pelletised, powder or other form, may constitute a blend.

Once mixed, the pelletised additives are transferred from material reception hopper 202 via a rotary valve 208 located at the bottom of the hopper. From hopper 202, the mixture of pelletised additives is directed by rotary valve 208 to transfer pipe 210. Rotary valve 208 is driven by a motor having a power of typically 0.75 kW to provide a rotor speed of from 50 to 70 rpm. The pelletised additives may then be forced along transfer pipe 210 by air from blower 204. The rotary valve 208 may control the flow of material along transfer pipe 210 to give a constant rate of flow therein. The rate of rotation of rotary valve 208 may be linked to the operation of blower 204. This is sequenced by means of a control timer provided on a main control panel of apparatus 200 (not shown in FIG. 6). In two preferred embodiments, blower 204 may have a power of 5.5 kW and operate at 2900 rpm or 7.5 kW and operate at 3000 rpm, providing a conveying rate of the pelletised additives along transfer pipe 210 of between 12 and 24 $m^3$ per hour, according to throughput requirements. Approximate throughput rates, expressed in tonnes per hour, are shown in Table I.

TABLE I

| Horizontal length of transfer pipe 210 | Vertical length of transfer pipe 210 | No. of 90° bends in transfer pipe 210 | Approx. throughput 5.5 kW blower | Approx. throughput 7.5 kW blower |
|---|---|---|---|---|
| 5 m | 7 m | 2 | 11 t/h | 14 t/h |
| 5 m | 10 m | 3 | 9 t/h | 11 t/h |
| 10 m | 10 m | 2 | 9 t/h | 12 t/h |
| 10 m | 15 m | 3 | 7 t/h | 9 t/h |
| 15 m | 15 m | 4 | 6 t/h | 8 t/h |
| 15 m | 20 m | 5 | 5 t/h | 6 t/h |

In order to adjust the rate of flow of air output by blower 204 to transfer pipe 210, apparatus 200 may include a slide valve 206. Slide valve 206 is pneumatically operated to vary the air output from blower 204 to transfer pipe 210 according to requirements. Air output by blower 204 can be diverted from transfer pipe 210 by slide valve 206 to an exhaust outlet. This permits the blower to be kept running at a constant rate when the rate of flow of air from blower 204 to transfer pipe 210 needs to be varied according to requirements or even when no additives are to be propelled along transfer pipe 210 at all. Adjusting the rate of revolution of blower 204 or switching blower 204 on and oft both of which shorten its working lifetime, may thereby avoided, and may extend the working lifetime of the blower. A silencer 212 may be fitted to the exhaust from slide valve 206 for health and safety reasons. To perform the above-described control of the apparatus 200, a control system 205 is linked to communicate with at least the supply auger(s) 32 at the inlet to the hopper 202, the mixer (vertical auger 203), the scale (load cells 214), and the transfer system (the blower 204, the slide valve 206, and the rotary valve 208).

FIGS. 7A to 7D show the exterior appearance of apparatus 200. The components shown in FIG. 6 and described above are contained within an enclosure, which is preferably manufactured from Plastisol™ coated steel. The enclosure may be provided with removable access panels to permit servicing of the internal components of apparatus 200. Typical exterior dimensions of the enclosure are 2.4 m in length by 1.3 m in width by 1.9 m in height.

Apparatus 200 is very versatile because storage vessels for the pelletised additives, particularly if cari silos 100 of the type shown in FIG. 4, are interchangeable, allowing different pelletised additives to be combined and mixed in desired proportions. Pelletised fibres, colour pigment pellets, binders and polymers may therefore all be added to an asphalt mixing box by means of the apparatus 200 in desired proportions and at the same time in a well pre-blended condition. As apparatus 200 is fully automated, the health and safety risks of manual handling of non-pelletised additives may be eliminated. Asphalt mixing cycletimes may also be kept to a minimum by eliminating the need for dry mixing of non-pelletised additives prior to the wet mix process conducted in the main asphalt mixing box through pre-blending of pelletised additives by means of apparatus 200. This enables better additive dispersion in the asphalt product and consistent product density, through the use of pelletised additives.

The above preferred embodiments have been described by way of example only and other embodiments of the present invention will be apparent to those skilled in the art from consideration of the detailed description given above and of the accompanying drawings. Thus any limitations on the present invention are to be found only in the claims set out below.

What is claimed is:

1. An apparatus for providing at least one additive for incorporation in an asphalt, said apparatus comprising:

a receptacle constructed and arranged to receive one or more of said additives;

a scale adapted to measure respective gravimetric amounts of said one or more additives that are received by the receptacle;

a mixer adapted to mix said one or more additives in said receptacle into a blend, said mixer comprising a vertical auger centrally located in said receptacle;

a transfer pipe coupled with said receptacle via a rotary valve; and a positive or negative pressure pneumatic source connected to said transfer pipe downstream of the rotary valve for transporting said blend from said receptacle along said transfer pipe.

2. An apparatus according to claim 1, comprising one or more inlets for said additives that communicate with said receptacle, each of said one or more inlets being respectively compatible with an outlet from a centreless auger to receive said additives.

3. An apparatus according to claim 1, wherein said scale is adapted to measure gravimetric amounts of materials in said receptacle and comprises one or more load cells tared to account for the weight of said receptacle when empty.

4. An apparatus according to claim 1, wherein the rotary valve includes a motor-driven rotary valve.

5. An apparatus according to claim 1, wherein said mixer is adapted to blend pelletised additives.

6. An apparatus according to claim 1, wherein:

said transfer pipe is connected between said receptacle and an input of an asphalt mixing box.

7. An apparatus for preparing a blend of additives for incorporation in an asphalt, said apparatus comprising:

a receptacle, having an inlet, for receiving one or more of said additives;

weighing means connected to said receptacle for measuring respective gravimetric amounts of said additives;

mixing means for mixing said additives in said receptacle into a blend;

transfer means for directing said blend of additives from said receptacle, said transfer means including a transfer pipe coupled to said receptacle via a rotary valve;

a control system having an input from said weighing means and control outputs to said inlet of said receptacle and to said mixing means and said transfer means, said control system being programmable to regulate receipt of said additives through said receptacle inlet based on gravimetric amounts of additives measured by said weighing means until a desired total amount of said additives in desired proportions thereof is achieved, and to operate said mixing means and said transfer means sequentially thereafter; and a positive or negative pressure pneumatic source connected to said transfer pipe downstream of the rotary valve for transporting said blend from said receptacle along said transfer pipe.

8. An apparatus according to claim 7, comprising one or more inlets for said additives, each of said inlets being respectively compatible with an outlet from a centreless auger.

9. An apparatus according to claim 7, wherein said weighing means comprises one or more load cells tared to account for a weight of said receptacle when empty.

10. An apparatus according to claim 7, wherein said mixing means comprises a vertical auger centrally located in said receptacle.

11. An apparatus according to claim 7, wherein the-rotary valve includes a motor-driven rotary valve.

12. An apparatus according to claim 7, adapted to blend pelletised additives.

13. An apparatus for delivering additives for incorporation in an asphalt to an asphalt mixing box, said apparatus comprising:

a receptacle constructed and arranged to receive said additives, said receptacle having an input for said additives locatable at a level substantially lower than an input for said asphalt mixing box;

weighing means connected to said receptacle for measuring respective gravimetric amounts of said additives;

a mixer adapted to mix said additives and prepare a blend;

a transfer pipe between an output of said receptacle and an input of said asphalt mixing box;

transfer means for directing said blend of additives from said receptacle to said transfer pipe;

a pneumatic pressure source connected to said transfer pipe downstream of said output of said receptacle that conveys said blend along said transfer pipe from near the output of said receptacle to the input of said asphalt mixing box; and a control system having an input from said weighing means and control outputs to an inlet of said receptacle and to said mixer and said transfer means, said control system being programmable to regulate receipt of said additives through said receptacle input based on gravimetric amounts of additives measured by said weighing means until a desired total amount of said additives in desired proportions thereof is achieved, and to operate said mixer and said transfer means sequentially thereafter.

14. An apparatus according to claim 13, wherein said transfer pipe includes a vertical portion thereof.

15. An apparatus according to claim 13, further comprising a valve that regulates pressure developed by said pneumatic pressure source.

16. An apparatus according to claim 13, further comprising means for diverting pressure developed by said pneumatic pressure source from said transfer pipe to an exhaust.

17. An apparatus according to claim 13, adapted to deliver pelletised additives to said asphalt mixing box.

18. An apparatus according to claim 13, further comprising; means for diverting pressure from said transfer pipe to an exhaust, and wherein said control system has a control output to said pressure diverting means and is programmable to operate said pressure diverting means in coordination with said transfer means.

19. An apparatus according to claim 18, adapted to deliver pelletised additives to said asphalt mixing box.

* * * * *